United States Patent [19]

Cagneux et al.

[11] Patent Number: 5,002,301

[45] Date of Patent: Mar. 26, 1991

[54] SKI HAVING IMPROVED SHOCK ABSORPTION AND VIBRATION RESISTANCE

[75] Inventors: Yves Cagneux, Annecy Le Vieux; Denis Gasquet; Maurice Legrand, both of Annecy, all of France

[73] Assignee: Salomon S.A., Annecy Cedex, France

[21] Appl. No.: 442,458

[22] Filed: Nov. 30, 1989

Related U.S. Application Data

[63] Continuation of Ser. No. 194,147, May 16, 1988, abandoned.

[30] Foreign Application Priority Data

May 22, 1987 [FR] France ..... 87 07542

[51] Int. Cl.[5] ..... A63C 5/00

[52] U.S. Cl. ..... 280/602; 280/601; 280/610

[58] Field of Search ..... 280/601, 602, 608, 609, 280/610; 441/68

[56] References Cited

U.S. PATENT DOCUMENTS

| | | | |
|---|---|---|---|
| 2,695,178 | 11/1954 | Rheinfrank, Jr. | 280/610 |
| 3,132,874 | 5/1964 | Baudou | 280/610 |
| 3,208,761 | 9/1965 | Sullivan et al. | 280/610 |
| 3,503,621 | 3/1970 | Schmidt et al. | 280/610 |
| 3,635,482 | 1/1972 | Holman | 280/610 |
| 3,758,126 | 9/1973 | Zemlin et al. | 280/602 |
| 3,762,734 | 10/1973 | Vogel . | |
| 4,035,000 | 7/1977 | Lacroix | 280/610 |
| 4,261,778 | 4/1981 | Albrigtsen et al. | 441/68 X |
| 4,405,149 | 9/1983 | Piegay | 280/602 |
| 4,412,687 | 11/1983 | Andre | 280/610 |
| 4,537,417 | 8/1985 | Hirnbock et al. | 280/602 |
| 4,627,635 | 12/1986 | Koleda | 280/602 |
| 4,667,977 | 5/1987 | Lacroix | 280/610 |

FOREIGN PATENT DOCUMENTS

| | | | |
|---|---|---|---|
| 0193519 | 9/1986 | European Pat. Off. . | |
| 232484 | 8/1987 | European Pat. Off. | 280/610 |
| 285096 | 1/1914 | Fed. Rep. of Germany | 280/601 |
| 1428862 | 12/1968 | Fed. Rep. of Germany | 280/610 |
| 2133664 | 7/1971 | Fed. Rep. of Germany | 280/610 |
| 2706739 | 9/1977 | Fed. Rep. of Germany | 280/610 |
| 0985174 | 7/1951 | France . | |
| 1124600 | 10/1956 | France . | |
| 1304880 | 8/1962 | France . | |
| 2097849 | 3/1972 | France . | |
| 2267129 | 11/1975 | France . | |
| 2437225 | 4/1980 | France . | |
| 2611519 | 9/1988 | France . | |
| 21629 | 2/1978 | Japan | 280/610 |
| 0380613 | 9/1964 | Switzerland . | |
| 406933 | 8/1966 | Switzerland | 280/610 |
| 86/05994 | 10/1986 | World Int. Prop. O. | 280/610 |

*Primary Examiner*—Charles A. Marmor
*Assistant Examiner*—Tamara L. Finlay
*Attorney, Agent, or Firm*—Sandler, Greenblum & Bernstein

[57] ABSTRACT

A ski comprises a longitudinally extending body defining a longitudinal median plane and having a sole substantially perpendicular to the plane and adapted to slidably engage a surface. The sole has a central zone lying between front and rear contact zones. The body comprises a core having opposed top and bottom walls, and opposed lateral walls, the core extending substantially the length of the body. The body further includes a shell having a top layer overlying the top wall of the core and lateral surfaces spaced from respective lateral walls of the core. The shell further includes lateral strips of viscoelastic material interposed between each lateral surface of said shell and the respective lateral walls of the core for forming a shock absorber. The cross-sectional area of the lateral strips are a non-constant function of length along the body of the ski at least between said contact zones. As a consequence, a desired distribution of shock absorption properties along the length of the ski can be established by suitable selection of the cross-sectional area of the strips.

40 Claims, 2 Drawing Sheets

SKI HAVING IMPROVED SHOCK ABSORPTION AND VIBRATION RESISTANCE

This application is a continuation of application Ser. No. 07/194,147, filed May 16, 1988 now abandoned.

BACKGROUND OF THE INVENTION

1. Field of the Invention

This invention relates to skis utilized in Winter sports, and adapted to slide on snow and ice.

2. Related Applications

The following copending applications disclose subject matter related to subject matter in the present application:

Ser. No. 156,962 filed Feb. 8, 1988;

Ser. No. 157,467 filed Feb. 18, 1988;

Ser. No. 194,129 filed May 16, 1988 (P6374);

Ser. No. 194,320 filed May 16, 1988 (P6375).

3. Description of Background Information

A ski generally comprises a lower sliding surface having an angle iron on each lateral edge for gripping snow, two lateral surfaces defining the width of the ski, and an upper surface having binding means located in a central binding zone by which a user attaches his boot to the ski. The front or leading end of the ski is curved upwardly to form a spatula; and the ski is relatively narrow in width compared to its length which defines a longitudinal direction. The lower surface of the ski defines a contact zone located between a front contact line and a rear contact line.

In conventional skis, the thickness of the body of the ski varies along the length of the ski in the longitudinal direction having a maximum in the central binding zone where the flexional movements are a maximum during the use of the ski. In this zone, internal flexion couples are greatest during the use of the ski. Because the thickness of the ski in the central binding zone is a maximum, and the thickness near the front and rear ends is a minimum, a uniform load distribution is achieved as disclosed in French Patent No. 985,174, for example.

Conventional skis have a composite structure in which different materials are combined in a manner such that each composite operates in optimal fashion taking into account the distribution of the mechanical stresses. The composite structure comprises resistance or reinforcing strips of a material having a high mechanical resistance to strain and substantial rigidity so as to resist flexional and torsional stresses produced in a ski during its use. The conventional structure usually includes filler material, and sometimes shock absorption strips.

The two principal composite structures finding current wide scale application in skis are the so-called sandwich and casing structures. In a typical casing structure, such as described in French Patent No. 985,174, and FIG. 3 of French Patent No. 1,124,600, the ski comprises an internal core made of cellular material which may be partially hollow, and mechanical resistance strips surrounding the core in the form of layers that constitute a casing for the core.

In a typical sandwich structure, such as described in U.S. Pat. No. 4,405,149, the ski comprises a central core formed from cellular material which can be partially hollow, and reinforcements on its upper and lower surfaces formed by resistance layers having requisite resistance and rigidity properties greater than those of the core itself Typically, discontinuous strips of prestressed viscoelastic material are bonded to the core along two or three separate longitudinally spaced zones. At least one of these zones is near the spatula of the ski, and another of the zones is located adjacent the binding zone. Swiss Patent No. 525,012 discloses longitudinal strips formed of viscoelastic material bonded to the upper surface of the ski to form a sandwich structure.

In all of the known skis using a sandwich construction in which the shock absorption strips are formed of viscoelastic material, both the core and the strips have a uniform width along their entire length. When the strips are positioned substantially over the entire length of a ski, it has been found that skiing comfort is improved, but that the gripping and holding power of the ski during turning maneuvers are reduced. In efforts to solve this problem, it has been proposed to limit the length of the shock absorber to the front half of a ski, i.e , to the zone between the spatula and the binding zone. Such an expedient, however, appears to provide no advantage over a construction in which the shock absorber extends over the entire length of the ski. Finally, in the case where the strip is segmented or divided into a plurality of separate segments, as is described in U.S. Pat. No. 4,405,149, the shock absorption effect is reduced, and the influence of the segments becomes practically negligible at the frequencies of vibration produced in the ski under normal use when a boot is attached to the ski by a binding.

Furthermore, in conventional skis using a sandwich construction, the shock absorption element constitutes a supplemental element which complicates the manufacture of the ski and substantially increases its cost.

An object of the present invention, therefore, is to overcome the disadvantages of known ski structures and provide a ski whose shock absorption properties are such as to produce a remarkable increase in both comfort and technical performance.

Another object of the invention is to confer to the body of the ski, a shock absorption property which is a nonconstant function of the length of the ski. A further object of the present invention is to obtain a desired nonconstant distribution in the shock absorption properties of a ski without major modification of its structure in order to achieve homogeneity of structure and behavior, and good distribution of reactions along the length of the ski thus providing the user with an impression of comfort and regularity in the reactions of the ski to its travel on snow.

SUMMARY OF THE INVENTION

A ski according to the present invention comprises a longitudinally extending body defining a longitudinal median plane, and having a sole substantially perpendicular to the plane and adapted to slidably engage a surface, said sole having a central zone lying between front and rear contact lines. The body comprises a core having opposed top and bottom walls, and opposed lateral walls, said core extending substantially the length of the body. The body also includes a shell have a top layer overlying the top wall of the core, and lateral surfaces spaced from respective lateral walls of the core. Finally, the body includes lateral strips of viscoelastic material interposed between each lateral surface of said shell and the respective lateral walls of said core for forming shock absorption means. According to the invention, the area and configuration of the cross-section of said lateral strips are a non-constant function of the length of said body at least between said contact lines.

As a consequence of this construction, a predetermined distribution of shock absorption properties can be built into a ski. Vibrations that are most disturbing during the time a ski is in use are reduced by the structure according to the present invention so as to be almost imperceptible. Simultaneously, the absence of vibrations in the same range of frequencies produces a substantial increase in the gripping power of the ski on ice or hard snow, in its stability on bumpy snow, and in its stability in turns, and during its sliding.

Where the thickness of said core measured between the top and bottom walls thereof is substantially constant in the longitudinal direction of said core, its width measured between its lateral side walls varies longitudinally as a nonconstant function of distance in the longitudinal direction. Preferably, each lateral strip is substantially continuous over the length of said body.

In some embodiments of the invention, the width of the core measured between its two lateral walls is greater in the central zone of the ski than adjacent the front and rear contact lines. The width of the core decreases progressively and substantially continuously from said central zone toward said front and rear contact lines in one embodiment of the invention. In another embodiment, the width of said core is reduced adjacent one of said contact lines relative to the width in said central zone. The width of said core may be reduced in the vicinity of the front contact line. Alternatively, or in addition, the width of the core may be reduced in the vicinity of said the contact line.

In some embodiments of the invention, the core is symmetrical in width about the longitudinal median plane. Thus, the width of said core may be reduced adjacent both the front and rear contact lines, or adjacent just the rear contact line, or adjacent just the front contact line. Furthermore, the transition in width of said core may be either discontinuous or continuous.

When the top layer of the shell is spaced from the top wall of the core, the ski may include a longitudinal strip of viscoelastic material interposed between the top layer of the shell and the top wall of the core for forming shock absorption means. In such case, the longitudinal strip is substantially continuous over the length of said body. Alternatively, or in addition, a longitudinal strip of viscoelastic material may be interposed between the bottom wall of the core and the sole of the ski for forming additional shock absorption means.

The present invention thus provides a ski whose body comprises a longitudinal core, mechanical resistance strips, internal longitudinal shock absorption strips means of viscoelastic material, and filling material connecting the resistance strips to the other components. The internal shock absorption means are in the form of strips of viscoelastic material having a cross-section transverse to the ski, and whose area and configuration vary along the length of the body of the ski as a function of the longitudinal position under consideration. That is to say, the present invention provides for a variation in the cross-sectional area and the shape of the strips along the length of the ski. In the present invention, such variation is achieved by utilizing a core whose thickness is constant and whose width varies along the length of the ski.

In the present invention, a portion of the shock absorption means is in the form of two longitudinally extending lateral strips of viscoelastic material, the strips being positioned on opposite lateral sides of the longitudinal core. The width of each lateral strip is established by the corresponding lateral surface of the ski and a side wall of the core. In order for the width of the lateral strips of viscoelastic material to be a non-constant function of length along the ski when the ski width is constant, the core width may vary longitudinally along the ski; or the core may have a constant width in the lengthwise direction when the ski width varies longitudinally. In either case, the mechanical shock absorption properties of the ski are made to vary longitudinally along the ski. In this way, almost any desired distribution of shock absorption properties can be built into a ski by proper selection of the width distribution of the lateral strips of viscoelastic material. Moreover, this arrangement provides, in a simple manner, a ski that has effective shock absorption properties over a wide range of frequencies.

According to a preferred embodiment, the width of the core is selected such that the cross-section of the shock absorption strips in the central zone and/or adjacent the end of the skis is less than the cross-section of the same shock absorption strips adjacent to the front end and the rear end of the contact zone of the ski. The shock absorption is thus maximized in the most stressed zones of the ski during its use with the boot affixed to the ski by a binding.

According to one particularly preferred embodiment, the shock absorption strips are constituted by filling elements formed of viscoelastic material located between the core and the ski casing. The structure of the ski is thus considerably simplified.

Longitudinal variation in the cross-section of the shock absorption strips may be achieved by longitudinal variations in the Width of the core, or by the spacing, and possibly by longitudinal variation in the inclination of the lateral wall of the ski. In addition, the desired variation may be achieved by longitudinal variations in the spacing between the upper and lower surfaces of the ski.

The effect of varying the cross-section of the shock absorption strips is preferably obtained when the sides of the core are vertical and the width of the core varies longitudinally along the ski. In such a case, the space between at least one of the lateral external walls of the ski and the corresponding side wall on the core, is variable along the length of the body of the ski.

Such a variable shock absorption structure can be achieved using a resistant sandwich structure. But this variable shock absorption structure can be achieved using a casing resistance structure as well. Thus, the gripping quality of a ski can be increased by the combination of the intrinsic qualities of the casing and of the anti-vibrational effect of the structure according to the invention.

Preferably, longitudinal symmetry of the ski is achieved by positioning the shock absorption strips symmetrically with respect to a vertical longitudinal median plane of the ski. Distributed shock absorption properties may also be obtained when the shock absorber strips are unsymmetrical, the asymmetry being achieved with respect to the longitudinal median plane of the ski. Alternatively, the desired result can be achieved by a symmetrical arrangement in which the cross-sectional area of the shock absorber strips vary as a function of the longitudinal position under consideration.

According to one embodiment of the invention, the cross-section of the shock absorption strips varies in a continuous manner along the length of the body of the ski producing a continuous variation in mechanical shock absorption. According to other embodiments of the invention, the lateral surface of the core have zones of lesser width positioned at locations where it is desirable to increase the cross-section of the shock absorption strips.

BRIEF DESCRIPTION OF THE DRAWINGS

Embodiments of the present invention are shown in the accompanying drawings wherein.

DESCRIPTION OF PREFERRED EMBODIMENT

Figure 8:
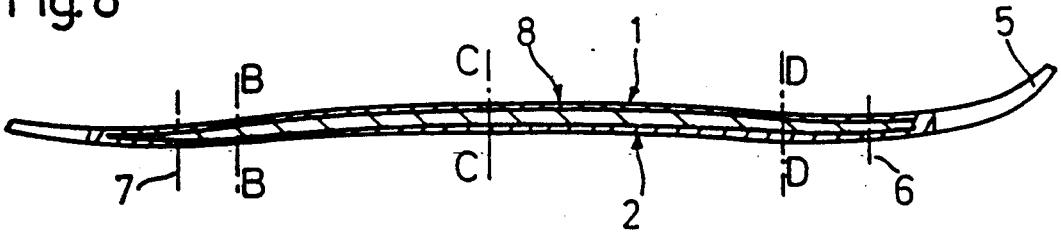
FIG. 8 illustrates a cross-sectional elevation view of the ski taken along the longitudinal axis of the ski shown in FIG. 6.
Figure 10:
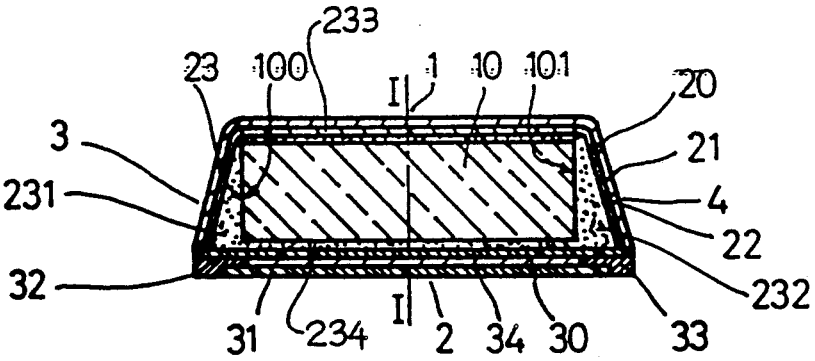

Referring first to FIG. 10 of the drawings, a ski according to the present invention includes upper surface 1, lower surface 2 (also referred to as a sole or sliding surface), first lateral exterior appearance surface 3, second lateral exterior surface 4, and a front end which is upwardly curved in the form of spatula 5 (FIG. 8). Lower surface 2 of the ski between front contact line 6 and rear contact line 7 defines a snow contact zone of the ski which, when not in use, is arched upwardly or cambered. The body of the ski, or the portion of the ski included between front contact line 6 and rear contact line 7, has a maximum thickness in central zone 8, and a thickness which decreases progressively approaching both the front contact line 6 and rear contact line 7.

Figure 9:
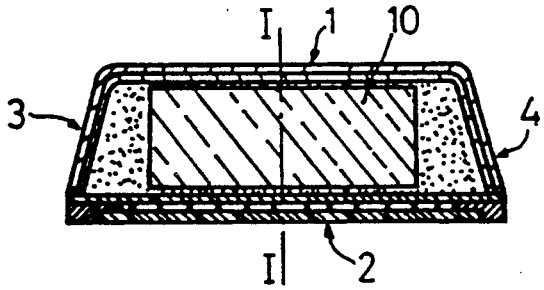
FIGS. 9–11 respectively illustrate transverse cross-sectional views of the ski of FIG. 6 along respective vertical planes B—B, C—C, and D—D shown in FIG. 8.
Figure 11:
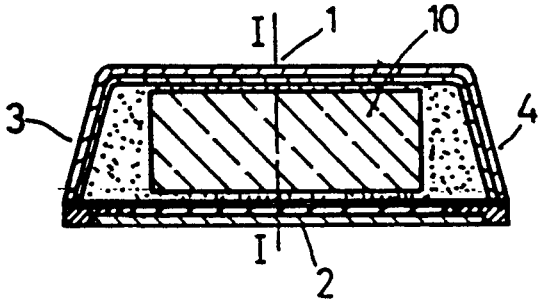

In the embodiment shown in FIGS. 9–11, the ski has a symmetrical mechanical resistance casing structure with respect to vertical longitudinal median axis I—I of the ski which defines a longitudinal median plane. FIG. 10 is a transverse cross-section of the ski in its central zone 8, namely, a cross-section along line C—C of FIG. 8. As shown in FIG. 10, the ski is constituted by four principle portions: core 10 having a substantially rectangular cross-section, shell 20, lower element 30, and filling 23.

Core 10 may be a cellular structure such as wood, synthetic foam, or aluminum honey-comb. The core may be partially hollow and may be constituted, for example, by metallic or plastic tubes.

Shell 20, in this embodiment, is a composite shell comprising outer exterior layer 21 of thermoplastic material, for example, and reinforcement layer 22 constituted from a material having high mechanical resistance such as stratified or alloyed aluminum, for example.

Exterior layer 21 may be a thermoplastic material such as ABS (acrylonitrile butadiene styrene), a polyamide, or a polycarbonate.

Reinforcement layer 22 may be one or more sheets or layers of woven glass, carbon or other material, these layers preferably being pre-impregnated with a thermoplastic resin such as a polyetherimide, or with a thermosetting resin such an epoxyde, or a polyurethane. The fabric is preferably oriented, and may have 90% of its fibers arranged in the longitudinal direction of the ski, and 10% in the transverse direction of the ski.

Interior filling layer 23, of viscoelastic material, ensures a linkage or connection between core 10 and reinforcement layer 22. The application to skis of viscoelastic material to provide shock absorption is described in the previously noted patents identified above. As is known, a suitable viscoelastic material can be selected from thermoplastic materials, synthetic resins, silicon elastomers, rubbers, butyl polychloroprenes, acrylic nitriles, ethylenes, propylenes, and ionomers. Such viscoelastic materials have properties that lie between those of a solid and a liquid, and serve to at least partially absorb shock and deformation forces. In liquids, stress is directly proportional to the rate of deformation; and in solids, stress is directly proportional to deformation. In a viscoelastic material, however, stress is a function of both the rate of deformation and of the deformation itself. In all of the embodiments, viscoelastic filling layer 23 is securely attached to the mechanical resistance elements by bonding or any other known process.

Lower element 30 comprises sole 31 of polyethylene constituting lower or sliding surface 2 of the ski. Lateral corner angles 32 and 33 at the lateral edges of sole 2 are of steel; and lower resistance layer 34 is a mechanically resistant material. For example, lower resistance layer 34 may have a composite structure comprising glass fibers and aluminum alloy or stratified aluminum. Lower resistance layer 34 is integrated along its lateral edges with with the corresponding lower lateral edges of reinforcement layer 22 of shell 20.

Reinforcement layer 22 of shell 20 has, as shown in the drawings, a cross-section in the form of an inverted U-shaped structure which constitutes an upper resistance layer connected to two lateral resistance layers attached at their lower edges to the lateral edges of lower resistance blade 34. As a result, reinforcement layer 22 of the shell and of the lower resistance layer 34 comprise an enclosed casing structure that surrounds core 10.

According to the invention, the width of core 10 is a non-constant function of the length of the body of the ski. Filling 23, made of a viscoelastic material, forms first lateral strip or volume 231, and second lateral strip or volume 232. In the embodiments shown, volumes 231 and 232 are connected by an upper longitudinal strip 233 in the form of a plate of viscoelastic material, and by a lower longitudinal strip 234 which is likewise in the form of a plate, all of the strips being integrally connected.

Variations in the width of core 10, i.e., variations in spacing between lateral walls 100 and 101 as a function of the length of the body between contact lines 6 and 7, effect variations in shape and cross-sectional area of lateral strips 231 and 232. For example, the cross-sectional area of viscoelastic material is greater in FIGS. 9 and 11, i.e., adjacent the front and rear quarters of the ski, than in the central portion shown in FIG. 10.

In the embodiments shown in the drawings, the internal shock absorption strips made of viscoelastic material are substantially continuous over the entire length of the body of the ski. As a result their transverse cross-sectional area and configuration can vary as a function of the longitudinal position being considered, but the shock absorption strips of the ski are uninterrupted, i.e., the strips have has no intermediate portion whose cross-section is zero.

Figure 1:
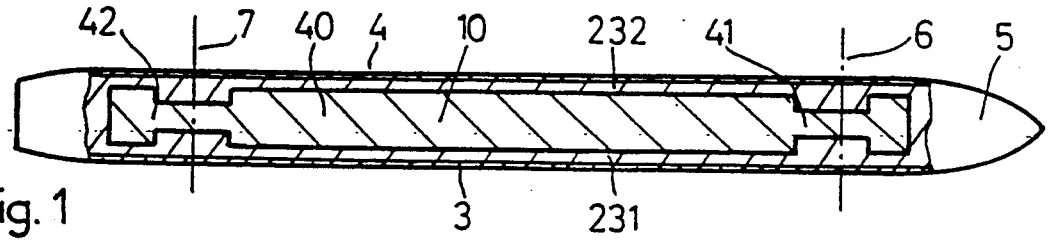
FIGS. 1–7 are top plan views, in partial cross-section, of a ski showing seven embodiments of the present invention.
Figure 2:
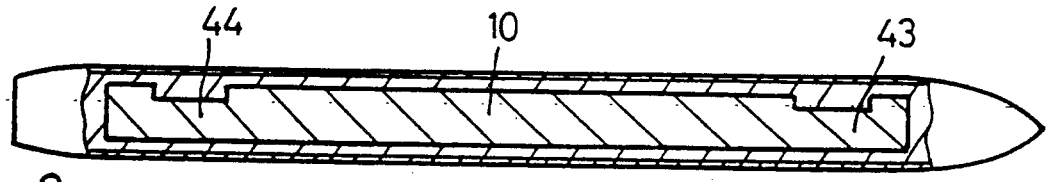
Figure 3:
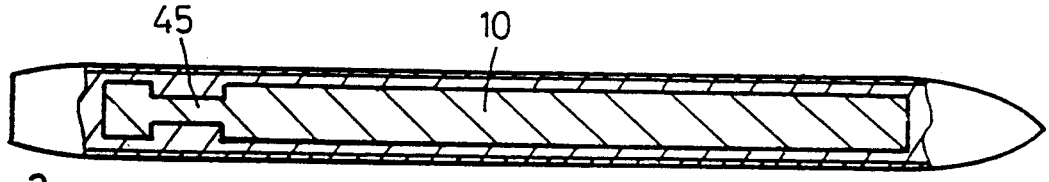
Figure 4:
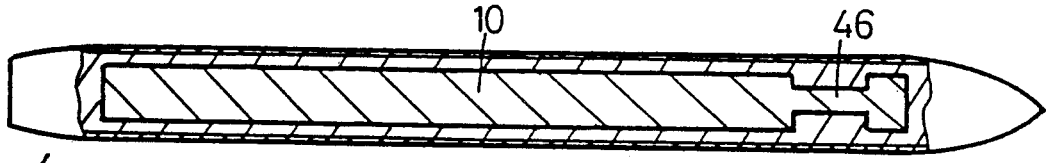

According to the invention, the adjustment of the shock-absorption is obtained by selecting, in an appropriate manner the width of core 10 and the type of viscoelastic material utilized. Thus, in the embodiment shown in FIG. 1, core 10 comprises central portion 40 having a substantially constant width, and two zones 41,42 of lesser widths being positioned, respectively, adjacent the front and rear contact lines 6, 7 which define both the length of the body and the contact zone of the ski. Zones 41, 42 of lesser width than the core establish corresponding zones of greater width of the viscoelastic strips 231 and 232; and these zones produce greater shock absorption capacity. In FIG. 1, zones 41 and 42 of the core are symmetrical with respect to longitudinal axis I—I of the ski.

Figure 5:
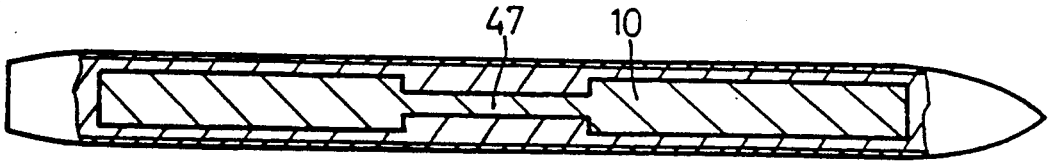

In the embodiment shown in FIG. 5 the core comprises a single zone 47 of lesser width positioned adjacent the central portion 8 of the ski. In the embodiment of FIGS. 1-5, the zones of lesser width have a substantially reduced width with respect to the width of the main portion of the core. For example, in FIG. 1, zones 41,42 have a width about half the width of core 10 in central zone 40. The transition in width of the core between zones of different width may be abrupt, or discontinuous as shown in Figs, 1-5. However, the transition may be more gentle or continuous to provide cutouts having a more gentle slope, tending to provide an intermediate solution between the embodiments of FIGS. 1-5 and the embodiments of FIGS. 6 and 7 described below.

Figure 6:
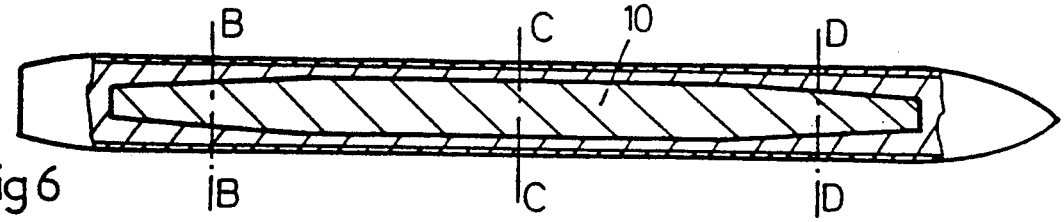
Figure 7:
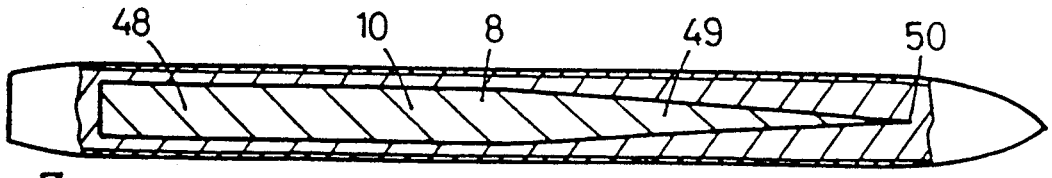

In the embodiment of FIGS. 6 and 7, the transition or variation in width of the core is continuous or progressive. In FIG. 6, the width of core 10 in the central zone adjacent transverse cross-sectional plane C—C, is greater than the width of the core adjacent the ends of the ski defined by cross-sectional planes B—B, D—D. The width of the core decreases progressively and substantially continuously from the central zone of the body of the ski towards each of the front and rear ends of the ski.

In FIG. 7, the core has a first rear portion 48 of substantially constant width and a second front portion 49 whose width decreases progressively from central zone 8 of the body of the ski toward the front end thereof. The decrease in width of the core is continuous, and substantially linear from the maximum width in central zone 8 of the body of the ski to a zero width at front end 50 of the core adjacent front contact line 6.

In the embodiments shown in the drawings, lateral walls 100 and 101 of the core are vertical, i.e., parallel to median plane I—I and are thus perpendicular to upper surface 1 and lower surface 2 of the ski. Lateral surfaces 3 and 4 of the ski are oblique as shown in FIGS. 9-11. It is within the scope of the present invention to modify the configuration of the core to provide oblique lateral walls that converge either upwardly or downwardly. Alternatively, lateral surfaces 3 and 4 of the ski could be vertical, or could have an inclination that is a non-constant function of the longitudinal position being considered along the length of the ski as disclosed in copending applications Ser. No. 156,962 and Ser. No 157,467, both of which were filed on Feb. 18, 1988, the disclosures of which are hereby incorporated by reference thereto.

Exterior appearance layer 21 of shell 20 is not absolutely necessary to obtain the particular affects according to the present invention. Thus, exterior layer 21 and reinforcement layer 22 could be combined into a single reinforcement layer.

The preceding embodiments have been described with reference to a mechanically resistant casing. The invention, however, is also applicable to a ski that utilizes a sandwich type mechanical resistance structure.

A ski according to the present invention can be manufactured by conventional means, for example a process of the type described in French Patent No. 985,174. However, the ski according to the invention can likewise be manufactured according to a process of the type described in French Patent No. 87 03119 belonging to Applicant.

The present invention also contemplates a core in which its thickness, as well as its width, is a nonconstant function of its length to provide more control over the distribution of shock absorption along the length of the ski.

Finally, although the invention has been described with reference to particular means, materials and embodiments, it is to be understood that the invention is not limited to the particular disclosed and extends to all equivalents within the scope of the claims.

We claim:

1. A ski comprising:

(a) a longitudinally extending body defining a longitudinal median plane, and having a sole substantially perpendicular to the plane and adapted to slidably engage a surface, said sole having a central zone lying between front and rear contact lines;

(b) said body comprising:

(1) a core having opposed top and bottom walls, and opposed lateral walls, said core extending substantially the length of the body;

(2) a shell have a top layer overlying the top wall of the core, and lateral surfaces spaced from respective lateral walls of the core; and (3) lateral strips of viscoelastic material interposed between each lateral surface of said shell and the respective lateral walls of said core for forming shock absorption means, each of said strips being unitary and extending continuously between said contact lines;

(c) the area and configuration of the cross-section of said lateral strips being a nonconstant function of the length of said body at least between said contact lines.

2. A ski according to claim 1 wherein the thickness of said core measured between the top and bottom walls thereof is substantially constant in the longitudinal direction of said core.

3. A ski according to claim 2 wherein the width of said core measured between its lateral side walls is a nonconstant function of the length of the core.

4. A ski according to claim 3 wherein each lateral strip is substantially continuous over the length of said body.

5. A ski according to claim 3 wherein the width of said core measured between its two lateral walls is greater in the central zone of the ski than adjacent the front and rear contact lines.

6. A ski according to claim 5 wherein said width of said core decreases progressively and substantially continuously from said central zone toward said front and rear contact lines.

7. A ski according to claim 3 wherein said width of said core is reduced adjacent one of said contact lines relative to the width in said central zone.

8. A ski according to claim 7 wherein said width of said core is reduced in the vicinity of said front contact line.

9. A ski according to claim 8 wherein said width of said core is reduced in the vicinity of said rear contact line.

10. A ski according to claim 7 wherein said width of said core is reduced adjacent said rear contact line.

11. A ski according to claim 7 wherein said core is symmetrical in width about said longitudinal median plane.

12. A ski according to claim 11 wherein said width of said core is reduced adjacent both the front and rear contact lines.

13. A ski according to claim 11 wherein said width of said core is reduced adjacent the rear contact line.

14. A ski according to claim 11 wherein said width of said core is reduced adjacent the front contact line.

15. A ski according to claim 7 wherein the transition in width of said core is continuous.

16. A ski according to claim 1 wherein said width of said core measured between its lateral walls is reduced adjacent said central zone relative to the width of said core adjacent one of said contact lines.

17. A ski according to claim 16 wherein the transition in width of said core is discontinuous.

18. A ski according to claim 1 wherein the width of said core measured between the lateral walls thereof is greater in the central zone of the ski than adjacent one of the contact lines.

19. A ski according to claim 18 wherein said width of said core is less adjacent the front contact line than in the central zone.

20. A ski according to claim 18 wherein said width of said core is less adjacent the front contact line than adjacent the rear contact line.

21. A ski according to claim 20 wherein said width of said core decreases progressively and substantially continuously from said central zone toward said front contact line.

22. A ski according to claim 1 wherein the top layer of said shell is spaced from the top wall of said core, and the ski includes a longitudinal strip of viscoelastic material interposed between the top layer of said shell and the top wall of said core for forming shock absorption means.

23. A ski according to claim 22 wherein said longitudinal strip is substantially continuous over the length of said body.

24. A ski according to claim 1 including a longitudinal strip of viscoelastic material interposed between the bottom wall of said core and the sole of said ski for forming shock absorption means.

25. A ski according to claim 24 wherein said longitudinal strip is substantially continuous over the length of said body.

26. A ski according to claim 1 wherein the lateral walls of said core are symmetrical about said median plane.

27. A ski according to claim 26 wherein said walls are parallel to said median plane.

28. A ski according to claim 1 wherein the lateral walls of said core are asymmetrical about said median plane.

29. A ski according to claim 28 wherein said lateral walls are parallel to said median plane.

30. A ski according to claim 1 wherein said shell includes a reinforcement layer that resists mechanical strain on the ski.

31. A ski according to claim 30 wherein said reinforcement layer is metallic.

32. A ski according to claim 1 wherein said top layer and said lateral surfaces of said shell include a reinforcement layer that resists mechanical strain on the ski.

33. A ski according to claim 32 wherein said shell includes a bottom layer in the form of a reinforcement layer that resists mechanical strain on the ski, said shell thus forming a casing surrounding said core.

34. A ski according to claim 1 wherein the sole of the ski is cambered.

35. A ski according to claim 1 wherein the width of said core in a direction perpendicular to said median plane is a nonconstant function of the length of the ski.

36. A ski according to claim 35 wherein the width of said ski measured between the lateral surfaces thereof is substantially constant between said contact lines.

37. A ski comprising:

(a) a longitudinally extending body defining a longitudinal median plane, and having a sole substantially perpendicular to the plane and adapted to slidably engage a surface, said sole having a central zone lying between front and rear contact lines;

(b) said body comprising:

(1) a core having opposed top and bottom walls, and opposed lateral walls, said core extending substantially the length of the body;

(2) a shell have a top layer overlying the top wall of the core, and lateral surfaces spaced from respective lateral walls of the core; and (3) lateral strips of viscoelastic material interposed between each lateral surface of said shell and the respective lateral walls of said core for forming shock absorption means;

(c) the area and configuration of the cross-section of said lateral strips being a nonconstant function of the length of said body at least between said contact lines;

(d) the thickness of said core measured between the top and bottom walls thereof being substantially constant in the longitudinal direction of said core;

(e) the width of said core measured between its lateral side walls being a nonconstant function of the length of the core; and (f) wherein said core is asymmetrical in width about said longitudinal median plane.

38. A ski according to claim 37 wherein said width of said core is reduced adjacent both of said front and rear contact lines.

39. A ski comprising:

(a) a longitudinally extending body defining a longitudinal median plane, and having a sole substantially perpendicular to the plane and adapted to slidably engage a surface, said sole having a central zone lying between front and rear contact lines;

(b) said body comprising:

(1) a core having opposed top and bottom walls, and opposed lateral walls, said core extending substantially the length of the body;

(2) a shell have a top layer overlying the top wall of the core, and lateral surfaces spaced from respective lateral walls of the core; and (3) lateral strips of viscoelastic material interposed between each lateral surface of said shell and the respective lateral walls of said core for forming shock absorption means;

(c) the area and configuration of the cross-section of said lateral strips being a nonconstant function of the length of said body at least between said contact lines;

(d) the thickness of said core measured between the top and bottom walls thereof being substantially constant in the longitudinal direction of said core;

(e) the width of said core measured between its lateral side walls being a nonconstant function of the length of the core; and (f) wherein the transition in width of said core is discontinuous.

40. A ski comprising:

(a) a longitudinally extending body defining a longitudinal median plane, and having a sole substantially perpendicular to the plane and adapted to slidably engage a surface, said sole having a central zone lying between front and rear contact lines;

(b) said body comprising:

(1) a core having opposed top and bottom walls, and opposed lateral walls, said core extending substantially the length of the body;

(b 2) a shell have a top layer overlying the top wall of the core, and lateral surfaces spaced from respective lateral walls of the core; and (b 3) lateral strips of viscoelastic material interposed between each lateral surface of said shell and the respective lateral walls of said core for forming shock absorption means;

(c) the area and configuration of the cross-section of said lateral strips being a nonconstant function of the length of said body at least between said contact lines;

(d) said width of said core being reduced adjacent said central zone relative to the width adjacent both said front and rear contact lines.

* * * * *